United States Patent [19]

Pyzel et al.

[11] 4,004,823

[45] Jan. 25, 1977

[54] TOURING SKI BOOT BINDING

[75] Inventors: Ewald D. Pyzel; Harold E. Codding, both of Reno, Nev.

[73] Assignee: Ski Safe Inc., Carson City, Nev.

[22] Filed: Aug. 8, 1975

[21] Appl. No.: 602,976

[52] U.S. Cl. ..... 280/615

[51] Int. Cl.[2] ..... A63C 9/10

[58] Field of Search ..... 280/11.35 B, 11.35 W, 280/11.35 L, 615, 614

[56] References Cited

UNITED STATES PATENTS

| | | | |
|---|---|---|---|
| 1,235,713 | 8/1917 | Michaud | 280/11.35 B |
| 2,516,238 | 7/1950 | Mortsell | 280/11.35 B |
| 2,559,020 | 7/1951 | Lehmkuhl | 280/11.35 B |
| 2,590,424 | 3/1952 | Lehmkuhl | 280/11.35 B |
| 3,003,777 | 10/1961 | Hilding | 280/11.35 B |
| 3,386,748 | 6/1968 | Eie | 280/11.35 B |
| 3,603,606 | 9/1971 | Eie | 280/11.35 B |
| 3,784,216 | 1/1974 | Maier, Jr. | 280/11.35 B |

*Primary Examiner*—Robert R. Song
*Assistant Examiner*—David M. Mitchell
*Attorney, Agent, or Firm*—Pennie & Edmonds

[57] ABSTRACT

The binding for releasably securing the toe of a touring ski boot to a touring ski comprises a ski binding member secured to the upper surface of a touring ski and a boot binding member secured to the toe of a touring ski boot. Each of the said binding members has a transversely disposed L-shaped binding element adapted to releasably engage each other, and spring loaded latch means for releasably retaining the binding members in engagement. The L-shaped binding element of the ski binding member has a horizontally disposed downwardly facing binding surface that abuts a corresponding horizontally disposed upwardly facing binding surface of the L-shaped binding element of the boot binding member. The L-shaped binding element of the ski binding member also has vertically disposed forward facing and rearward facing binding surfaces that abut corresponding vertically disposed rearward facing and forward facing binding surfaces of the L-shaped binding element of the boot binding member when said binding members are in mutual engagement with each other.

6 Claims, 13 Drawing Figures

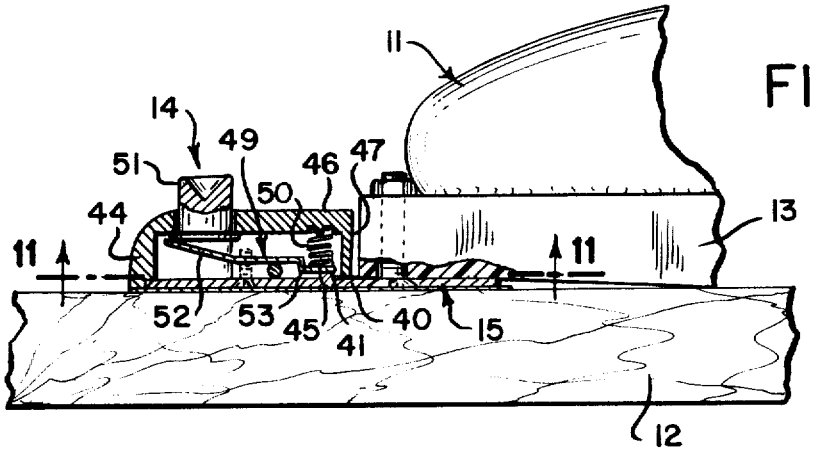
FIG. 9
FIG. 10
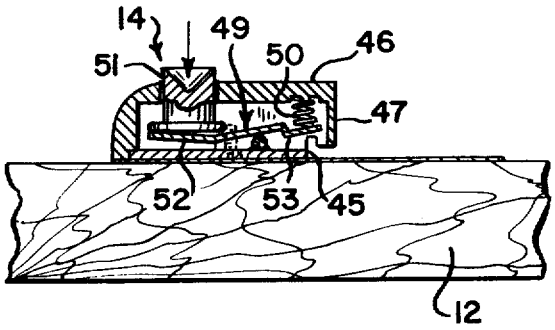
FIG. 11
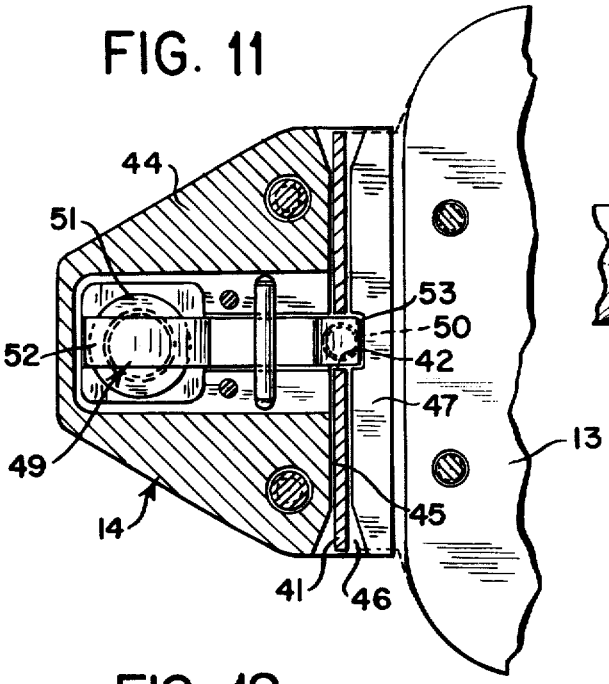
FIG. 12
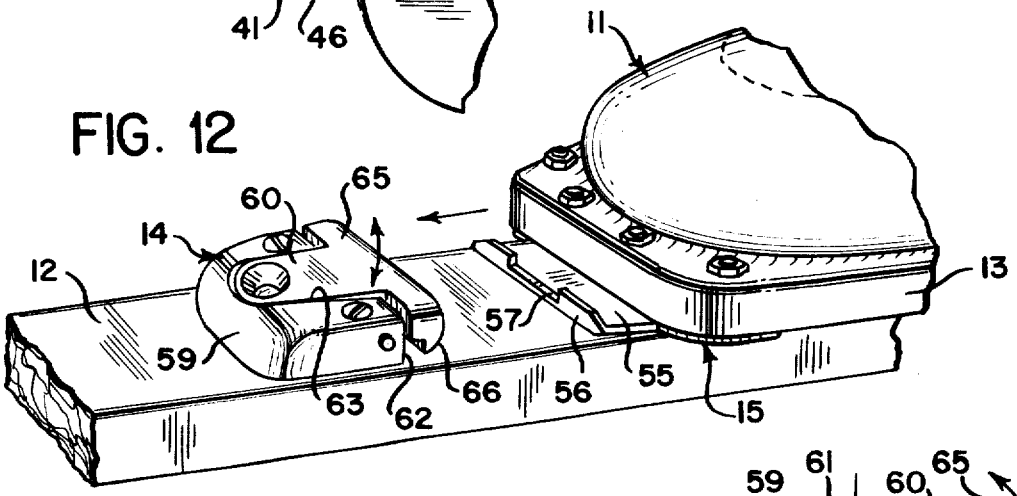
FIG. 13
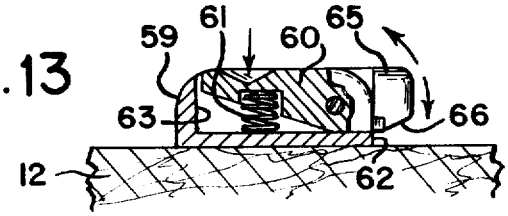

TOURING SKI BOOT BINDING

BACKGROUND OF THE INVENTION

1. Field of the Invention

This invention relates to ski boot bindings for touring skis.

2. Prior Art

Ski touring, or cross-country skiing, involves travelling on snow using very light weight, narrow skis. Suitable terrain for this type of skiing is less steep than most alpine, or downhill ski courses, and involves climbing, walking on level terrain and, inevitably, skiing down moderate slopes. Touring or cross-country skis, ski boots and ski bindings are markedly different from alpine or downhill skis, ski boots and ski bindings. Touring skis are long, narrow and light in weight and are fairly fragile. Alpine skis are considerably shorter and wider and are much heavier and stronger. Touring ski boots are comfortable and light weight with soft flexible uppers and flexible soles that are normally attached to the ski at the toe end only. Alpine ski boots are heavy rigid affairs with thick inflexible soles that are attached to the skis at both front and rear ends. Touring skis bindings normally secure the toe only of the ski boot to the ski, and these toe bindings do not have a safety release feature and must be released by hand. Alpine ski bindings have built-in safety release features which automatically release the ski boot in the event of an accident while skiing.

As noted, touring skis are of very light construction, usually of either laminated wood or fiberglass, and touring boots are light weight and low cut and have a very flexible sole to allow the boot heel to be raised freely while walking or gliding on the skis. Conventional touring ski boot bindings (of which there are several well known types) are of light weight construction in keeping with the need to minimize the weight of touring ski equipment. Due to the light weight of touring ski equipment and the generally low speeds and straight running of the touring skier, forces at the ski boot binding are small and no safety-release capability is required. Nonetheless, the ski boot binding should be capable of maintaining the toe of the ski boot securely fastened to the ski, while permitting the ski boot to flex freely and preventing as far as possible lateral motion of the boot relative to the ski when the skier is walking on his skis.

There are two main types of touring ski boot bindings commonly available to the touring skier — namely, the cable type and the pin type binding. Cable bindings employ a toe piece that is secured to the upper surface of the touring ski and that is adapted or shaped to receive the toe of a touring ski boot thrust thereinto. The toe piece has vertical wings which extend rearwardly alongside the front part of the ski boot to help align the ski boot on the ski. A cable attached either to the ski in front of the toe piece or to the toe piece itself extends around the heel of the ski boot to hold the boot in the toe piece. Pin bindings also employ a toe piece that is secured to the ski and that is shaped much like the toe piece of the cable binding. The toe piece of the pin binding is provided with vertical pins (usually 3) which fit into corresponding holes formed in the sole of the ski boot at the toe of the boot. A clamp pivotally mounted on the toe piece overlies the outer edges of the sole of the ski boot at the toe end thereof and securely clamps the toe of the boot on to the pins of the toe piece when the toe of the ski boot is in the toe piece and the clamp is at its secured position.

Neither the cable binding nor the pin binding provides an entirely satisfactory solution to the problem of securing the toe of the touring ski boot to a touring ski in that both types permit excessive lateral motion of the ski boot relative to the ski when the skier is walking. This excessive lateral motion of the ski boot is tiring and reduces control of the skis. In addition, the flared vertical wings of the toe piece project laterally outwardly from both sides of each touring ski and have a tendency to damage the other ski in the event the skis should run together.

After an intensive investigation into the problem of providing a satisfactory toe binding for touring skis, we have now devised an improved touring ski toe binding which is light in weight and reliable in operation, and which substantially eliminates lateral motion of the ski boot relative to the ski when the skier is walking without the requirement for any part of the toe binding to extend laterally outwardly beyond the side edges of the ski or ski boot.

SUMMARY OF THE INVENTION

Our improved touring ski binding comprises a ski binding member secured to the upper surface of a touring ski and a boot binding member secured to the toe of a touring ski boot, each of the binding members having transversely disposed L-shaped binding elements adapted to releasably engage each other. The ski binding member does not extend laterally beyond the side edges of the ski to which it is secured, and the boot binding member does not extend laterally beyond the side edges of the sole of the ski boot to which it is secured. The L-shaped binding element of the ski binding member has a horizontally disposed downwardly facing binding surface that abuts a corresponding horizontally disposed upwardly facing binding surface of the L-shaped binding element of the boot binding member, and it also has vertically disposed forward facing and rearward facing transverse binding surfaces that abut corresponding vertically disposed rearward facing and forward facing transverse binding surfaces of the L-shaped binding element of the boot binding member when said binding members are in mutual engagement with each other. Spring loaded latch means are provided for releasably retaining the binding members in engagement with each other.

In an advantageous embodiment of the invention the boot binding member has a horizontally disposed portion secured to the under surface of the sole of the ski boot at the toe end thereof and a vertically disposed portion extending upwardly along the transverse forward edge of said horizontally disposed portion, the horizontal and vertical portions of the boot binding member comprising the L-shaped binding element of this binding member. The ski binding member is formed with a L-shaped slot adapted to receive the L-shaped binding element of the boot binding member, said ski binding member having a vertically disposed transverse portion position directly rearwardly with respect to the vertically disposed portion of the boot binding member when said binding members are in mutual engagement with each other. In this embodiment vertically disposed portion of the boot binding member is formed with a latch receiving notch, and the spring loaded latch means advantageously comprises a longitudinally disposed latch lever pivotally mounted on the ski binding member for rotational movement to its latched position and to its unlatched position. The latch lever has a forward lever arm adapted to be moved from its latched position to its unlatched position and has a rearward lever arm in position to intersect and to be partially received in the L-shaped slot formed in the ski binding member when at its latched position and to be moved upwardly out of said L-shaped slot when at its unlatched position, a lever spring urging the latch lever to its latched position.

In another advantageous embodiment of the invention the boot binding member has a horizontally disposed portion secured to the under surface of the sole of the ski boot at the toe end thereof and a vertically disposed portion extending upwardly along the transverse forward edge of the horizontal portion of said boot binding member, the horizontal and vertical portions of the boot binding member comprising the L-shaped binding element of this binding member. The ski binding member has a base part secured to the upper surface of the ski, a latch part pivotally mounted on the base part of the ski binding member for movement about its pivot from its latched position to its unlatched position and return, and a latch part spring urging the latch part to its latched position. The base part has a vertically disposed transverse rearward edge, and the pivoted latch part has a horizontally disposed portion extending rearwardly from the base part and a vertically disposed transverse portion extending downwardly at the rearward edge of said horizontally disposed portion a predetermined distance rearwardly with respect to the transverse rearward edge of said base part, the base part and the latch part of the ski binding member defining between them the L-shaped binding element of said ski binding member. The horizontally disposed portion of the latch part of the ski binding member is adapted to overlie the vertically disposed portion of the boot binding member and the vertically disposed portion of the latch part is positioned rearwardly with respect to said vertically disposed portion when said binding members are in mutual engagement with each other. In this embodiment the vertically disposed portion of the boot binding member is advantageously formed with a latch receiving notch, and the horizontally disposed portion of the latch part of the ski binding member is formed with a latch lug adapted to be received in the latch receiving notch of the vertically disposed portion of the boot binding member.

BRIEF DESCRIPTION OF THE DRAWINGS

The improved touring ski binding of the invention will be better understood from the following description in conjunction with the accompanying drawings of which:

FIG. 9 is an enlarged fragmentary side view, partly in section, of the touring ski binding of FIG. 7 showing the pivoted latch lever of the ski binding member at its latched position;

FIG. 10 is a side view similar to FIG. 9, with ski boot removed, showing the pivoted latch lever of the ski binding member at its unlatched position;

FIG. 11 is a sectional view along line 11—11 of FIG. 9;

FIG. 12 is a perspective view of yet another advantageous embodiment of the touring ski binding of the invention showing the ski binding member and the boot binding member before they are engaged; and FIG. 13 is a side view, partly in section, of the ski binding member of the touring ski binding of FIG. 12.

DETAILED DESCRIPTION

Figure 1:
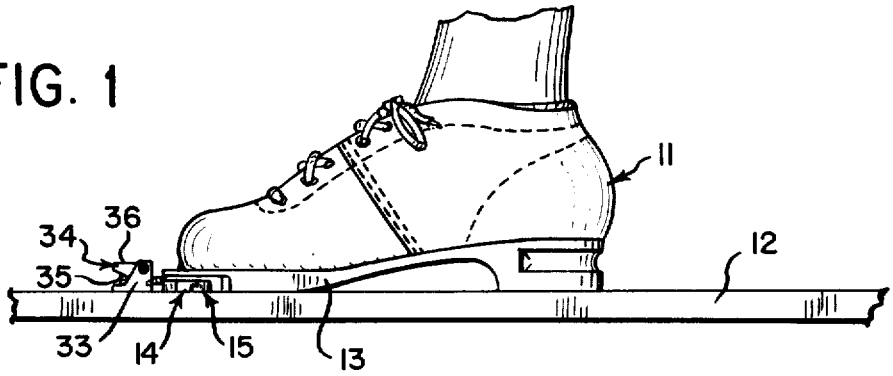
FIG. 1 is a side elevation of a touring ski boots and the center portion of a touring ski that is provided with an advantageous embodiment of the touring ski binding of the invention.

As hereinbefore described, touring skis are long and narrow and are of very light construction, usually of either laminated wood or fiberglass, and touring ski boots are light weight and low cut and have a very flexible sole to allow the boot heel to be raised freely while walking or gliding on the skis. As shown in the drawings the touring ski binding of the invention is designed to releasably secure the toe of a touring ski boot 11 to the upper surface of a touring ski 12, the ski binding securely fastening the toe end of the flexible sole 13 of the ski boot 11 to the ski 12 while permitting vertical movement of the heel end of the ski boot and preventing lateral movement of the ski boot relative to the ski as hereinafter described.

As shown best in FIGS. 1, 2, 7, 8 and 12 of the drawings the ski binding comprises a ski binding member 14 secured to the upper surface of the ski 12 and a boot binding member 15 secured to the under surface of the sole 13 of the ski boot 11 at the toe end thereof. The ski binding member 14 and the boot binding member 15 each have a transversely disposed L-shaped binding element adapted to releasably engage each other as hereinafter described. That is to say, the L-shaped binding element of one of the binding members is adapted to be received in an L-shaped slot formed in the other of said binding members, the L-shaped configuration of the L-shaped slot being defined in part by the L-shaped binding element of said other binding member. More particularly, the L-shaped binding element of the ski binding member 14 has a horizontally disposed downwardly facing binding surface that abuts a corresponding horizontally disposed upwardly facing binding surface of the L-shaped binding element of the boot binding member 15 when the binding members are in mutual engagement with each other. The L-shaped binding element of the ski binding member 14 also has vertically disposed forward facing and rearwardly facing transverse binding surfaces that abut corresponding vertically disposed rearward facing and forward facing transverse binding surfaces of the L-shaped binding element of the boot binding member 15 when the binding members are in mutual engagement with each other. The abutting horizontally disposed binding surfaces of the ski binding member 14 and the boot binding member 15 cooperate with the abutting vertically disposed transverse binding surfaces of said binding members to secure the toe of the ski boot 11 to the upper surface of the ski 12 and virtually eliminate lateral movement of the ski boot relative to the ski when the skier is walking on his skis.

In the embodiment of the touring ski boot binding shown in FIGS. 1 to 6 of the drawings, the ski binding member 14 secured to the upper surface of the ski 12 is provided with the L-shaped binding element described above, and the boot binding member 15 secured to the toe of the ski boot 11 is formed with the L-shaped slot that is adapted to receive the L-shaped binding element of the ski binding element 14.

In this embodiment, the ski binding member 14 has a vertically disposed transverse lower portion 17 secured to the upper surface of the ski 12 and a horizontally disposed transverse upper portion 18 spaced a predetermined distance above the upper surface of the ski 12. The vertical and the horizontal portions 17 and 18 of the ski binding member 14 comprise the L-shaped binding element of this member. The boot binding member 15 has a horizontally disposed portion 20 that comprises the horizontal leg of the L-shaped binding element of this member, and it also has vertically disposed transverse binding surfaces 21 and 22 which together with the horizontal portion 20 define the L-shaped slot of the boot binding member 15. The horizontal portion 20 of the boot binding member 15 underlies the horizontal portion 18 of the ski binding member 14 so that the under surface of the last mentioned portion 18 abuts the upper surface of the first mentioned portion 20, and the vertically disposed transverse binding surfaces 21 and 22 of the boot binding member 15 abut corresponding vertically disposed transverse binding surfaces of the ski binding member 14 when the binding members are in mutual engagement with each other as shown in FIGS. 1, 5 and 6.

Figure 2:
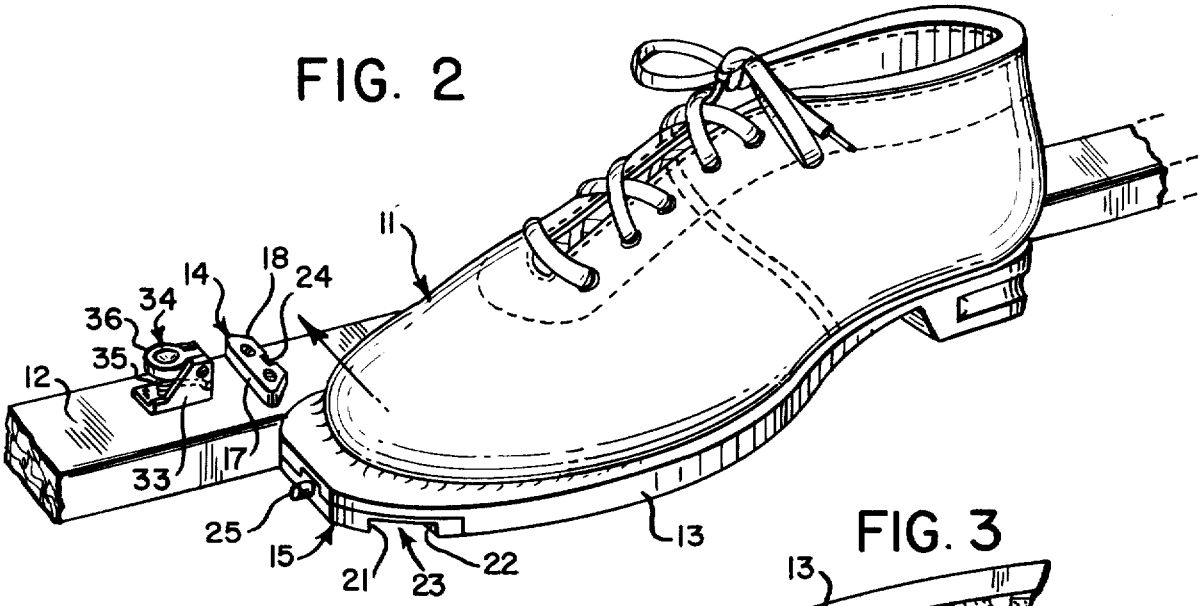
FIG. 2 is a perspective view of the touring ski boot, touring ski and touring ski binding of FIG. 1 showing the ski boot separated from the ski.
Figure 3:
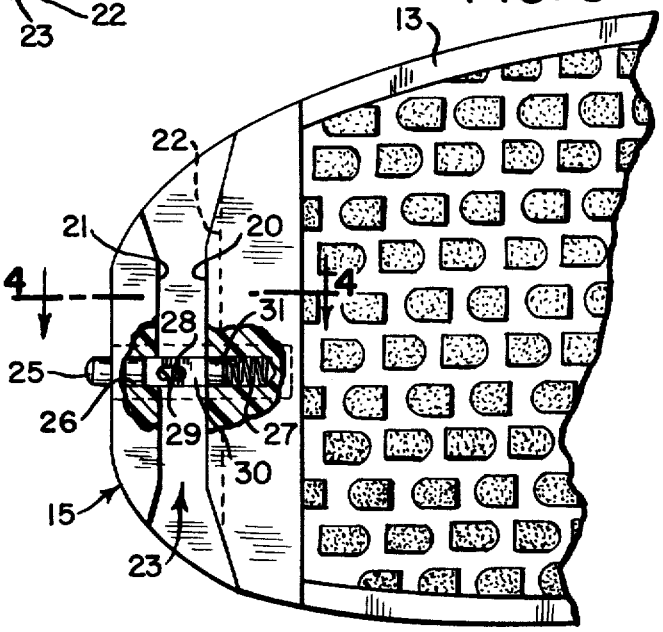
FIG. 3 is an enlarged fragmentary view from below of the forward end of the ski boot and boot binding member shown in FIGS. 1 and 2.
Figure 4:
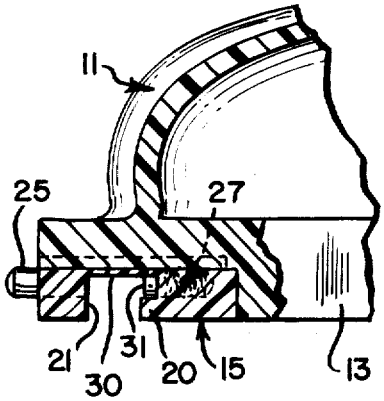
FIG. 4 is a sectional view along line 4—4 of FIG. 3.
Figure 5:
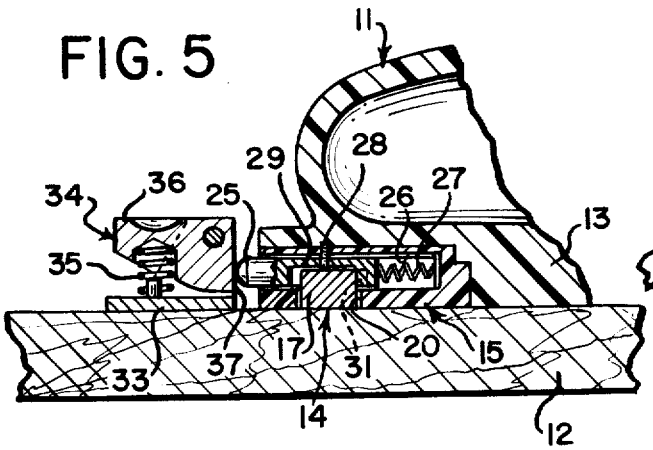
FIG. 5 is a fragmentary sectional view along the longitudinal center line of the ski boot, ski and ski binding of FIGS. 1 and 2.
Figure 6:
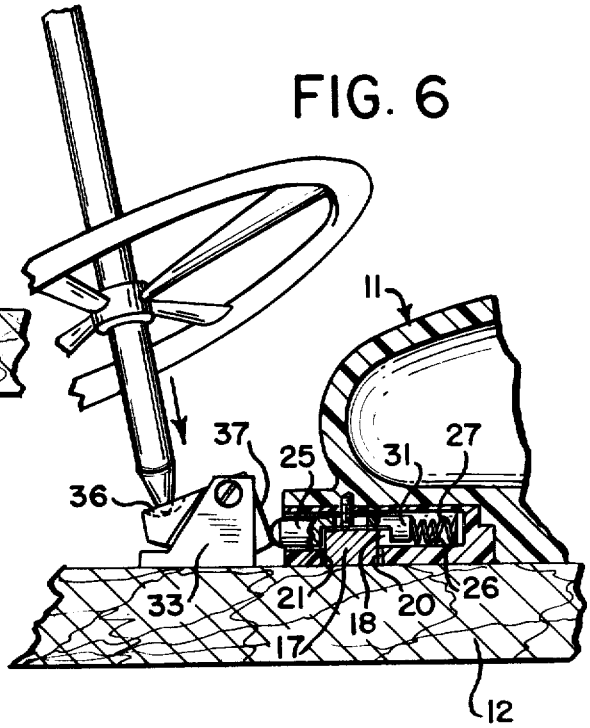
FIG. 6 is a view similar to FIG. 5, partly in section, showing how the latch plunger is moved rearwardly to its unlatched position by the latch disengager lever.
Figure 7:
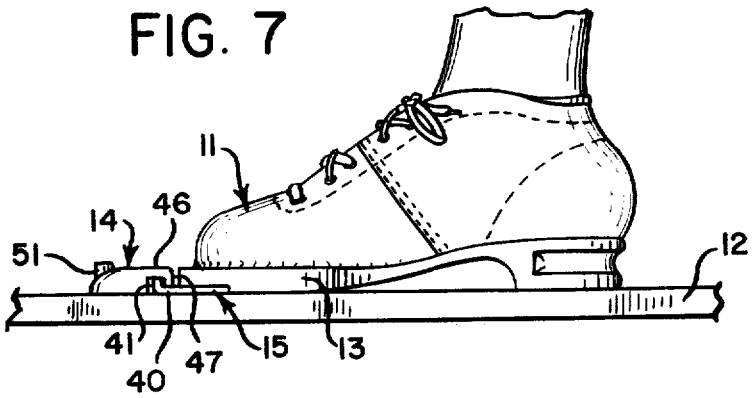
FIG. 7 is a side elevation similar to FIG. 1 showing another advantageous embodiment of the touring ski binding of the invention.
Figure 8:
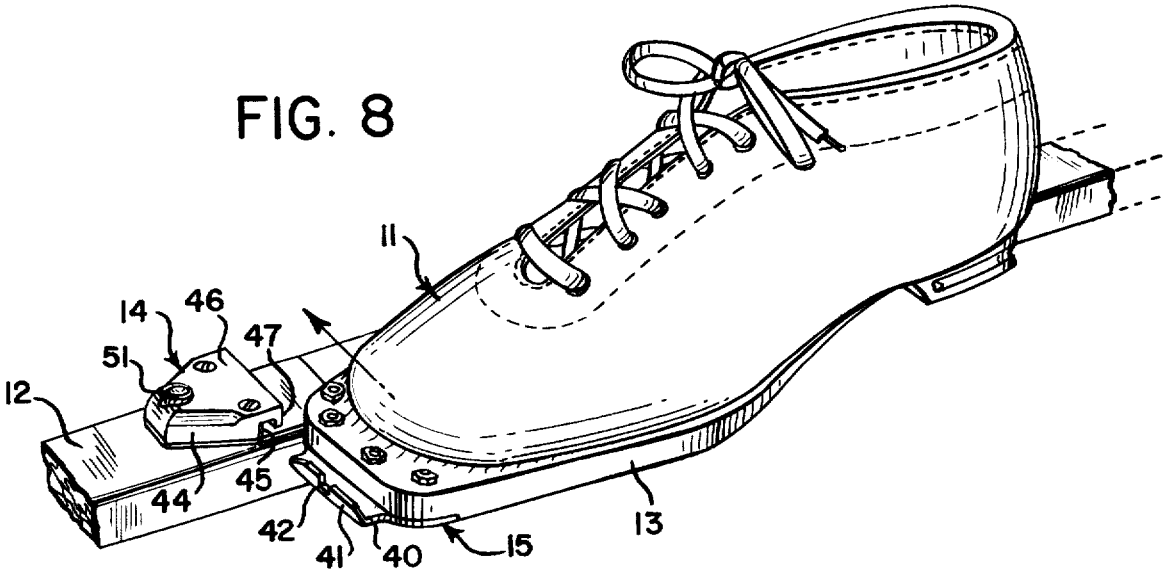
FIG. 8 is a perspective view of the touring ski boot, ski and ski binding of FIG. 7 showing the ski boot separated from the ski.

As shown best in FIG. 2, the horizontally disposed transverse upper portion 18 of the ski binding member 14 is formed with a latch receiving notch 24, and as shown best in FIGS. 3 to 6, a latch plunger 25 is mounted for longitudinal movement in a longitudinal bore 26 formed in the boot binding member 15. The latch plunger 25 is movable in the bore 26 from its latched position as shown in FIGS. 3, 4 and 5 to its unlatched position shown in FIG. 6. A latch plunger spring 27 urges the latch plunger 25 to its latched position, and a stud 28 secured to the boot binding member 15 and extending into the longitudinal slot 29 formed in the latch plunger 25 limits the longitudinal movement of the latch plunger and retains the plunger in the bore 26.

The latch plunger 25 is formed with a downward facing latch release recess 30 and with a latch engaging portion 31 disposed immediately adjacent the recess 30. The bore 26 in which the latch plunger 25 is received intersects the L-shaped slot 23 formed in the boot binding member 15. The recess 30 of the latch plunger 25 completely spans the L-shaped slot 23 of the boot binding member 15 when the latch plunger 25 is at its unlatched position as shown in FIG. 6, and the latch portion 31 of the latch plunger 25 extends into and partially blocks the L-shaped slot 23 when the latch plunger 25 is at its latched position as shown in FIGS. 3 to 5. When the L-shaped ski binding member 14 is received in the L-shaped slot 23 of the boot binding member 15 and the latch plunger 25 is at its latched position, the latch portion 31 of the latch plunger 25 is received in the latch notch 24 of the ski binding member 14, thereby securely latching the boot binding member 15 to the ski binding member 14. When the latch plunger 25 is at its unlatched position, the latch portion 31 of the latch plunger 25 is withdrawn from latch notch 24 of the ski binding member 14, thereby permitting the boot binding member 15 to be moved laterally out of engagement with the ski binding member 14.

To fasten the ski boot 11 to the ski 12, the ski boot is placed alongside the ski with the L-shaped slot 23 of the boot binding member 15 in alignment with the L-shaped ski binding member 14. The ski boot 11 is then moved sideways on to the ski 12, the tapered lateral ends of the ski binding member 14 contacting the latch portion 31 of the latch plunger 25 and pressing the latch plunger rearwardly to its unlatched position. When the ski boot 11 is centered on the ski 12, the latch notch 24 of the ski binding member 14 is in alignment with the latch plunger 25 of the boot binding member 15, thereby permitting the latch plunger spring 27 to move the latch plunger 25 and the latch portion 31 thereof forwardly into engagement with the latch notch 24 of the ski binding member 14. The ski boot 11 is removed from the ski 12 by pressing the latch plunger 25 rearwardly against the pressure of the latch plunger spring 27, thereby moving the latch portion 31 of the latch plunger out of engagement with the latch notch 24 of the ski binding member 14. The ski boot 11 and the boot binding member 15 thereof can then be moved laterally out of engagement with the ski binding member 14 of the ski 12.

The latch plunger 25 of the boot binding member 14 can be moved from its latched position to its unlatched position by manually pressing the forward end of the latch plunger rearwardly against the pressure of the latch plunger spring 27. However, we presently prefer to provide a latch disengaging means mounted on the upper surface of the ski 12 in position to be directly in front of the latch plunger 25 when the ski boot 11 is mounted on the ski 12. The latch disengaging means comprises a frame 33 secured to the upper surface of the ski 12, a latch disengaging lever 34 pivotally mounted on the frame 33 and a latch lever spring 35 that urges the latch disengaging lever 34 to its normal of inoperative position as shown in FIGS. 1, 2 and 5. The latch disengaging lever 34 has a horizontally disposed upper lever arm 36 and a vertical disposed lower lever arm 37, the lower lever arm 37 being in position to contact the forward end of the latch plunger 25 of the boot binding member 15 when the binding members 14 and 15 are in mutual engagement with each other. Downward movement of the upper lever arm 36 (for example, when the upper lever arm is depressed by a ski pole or the like as shown in FIG. 6) causes the lower lever arm 37 to press the latch plunger 25 of the boot binding member 15 rearwardly and thereby out of engagement with the latch receiving notch 24 the ski binding member 14.

In the embodiment of the touring ski binding shown in FIGS. 7 to 11 of the drawings the boot binding member 15 secured to the toe of the ski boot 11 is provided with an L-shaped binding element, and the ski binding member 14 secured to the upper surface of the ski 12 is formed with an L-shaped slot that is adapted to receive the L-shaped binding element of the boot binding member 15.

In this embodiment the boot binding member 15 secured to the under surface of the sole 13 of the ski boot at the toe end thereof is provided with a horizontally disposed portion 40 that extends forwardly a short distance beyond the forward end of the ski boot 11 and with a transverse vertically disposed portion 41 that extends upwardly along the transverse forward edge of the horizontally disposed portion 40, the vertically disposed portion 41 of the boot binding member being formed with a latch receiving notch 42. The horizontal portion 40 and the vertical portion 41 of the boot binding member 15 comprise the L-shaped binding element of this binding member. The ski binding member 14 has a housing 44 secured to the upper surface of the ski 12, the housing 44 having a rearward facing transverse vertical surface 45, a horizontally disposed portion 46 that extends rearwardly with respect to the transverse vertical surface 45, and a vertically disposed transverse portion 47 that extends downwardly at the rearward edge of the horizontally disposed portion 46 a predetermined distance rearwardly with respect to the transverse vertical surface 45 of the housing 44. The vertical surface 45 and the rearwardly and downwardly extending horizontal and vertical portions 46 and 47 of the housing 44 define between them the L-shaped binding element slot of the ski binding member 15. That is to say, the rearward facing vertically disposed surface 45 of the housing 44 of the ski binding member 14 is positioned directly in front of and in abutting relation with respect to the vertically disposed portion 41 of the boot binding member 15, the horizontally disposed portion 46 of the housing 44 of the ski binding member 14 overlies the upper edge of the vertically disposed portion 41 of the boot binding member 15 and the vertically disposed portion 47 of the housing 44 is positioned rearwardly and in abutting relation with respect to the vertically disposed portion 41 of the boot binding member 15 when the binding members 14 and 15 are in mutual engagement with each other.

The ski binding member 14 is provided with a longitudinally disposed latch lever 49 that is pivotally mounted on the housing 44 for rotational movement to its latched position and to its unlatched position, a latch lever spring 50 that urges the pivoted latch lever 49 to its latched position, and a push button 51 for moving the latch lever 49 to its unlatched position. The latch lever 49 has a forward lever arm 52 that extends forwardly from the latch lever pivot and a rearward lever arm 53 that extends rearwardly from the latch lever pivot in position to intersect the L-shaped slot formed in the ski binding member. When the latch lever 49 is at its latched position as shown in FIG. 9 the rearward lever arm 53 extends through and partially blocks the L-shaped slot of the ski binding member 14, and when it is at its unlatched position as shown in FIG. 10 the rearward lever arm 53 is moved upwardly out of the L-shaped slot to unblock said slot.

To fasten the ski boot 11 to the ski 12, the ski boot is placed alongside the ski with the L-shaped element of the boot binding member 15 in alignment with the L-shaped slot of the ski binding member 14. The ski boot 11 is then moved sideways on to the ski 12, the tapered lateral ends of the vertical portion 41 of the boot binding member 15 contacting the rearward lever arm 53 of the latch lever 49 and pressing the latch lever upwardly to its unlatched position. When the ski boot 11 is centered on the ski 12, the latch receiving notch 42 of the boot binding member 15 is in alignment with the latch lever 49 of the ski binding member 14, thereby permitting the latch lever spring 50 to move the rearward lever arm 53 of the latch lever 49 downwardly into engagement with the latch receiving notch 42 of the boot binding member 15 as shown in FIG. 9. The ski boot 11 is removed from the ski 12 by pressing the push button 51 downwardly against the pressure of the latch lever spring 50, thereby moving the forward lever arm 52 downwardly and the rearward lever arm 53 of the latch lever 49 upwardly out of engagement with the latch receiving notch 42 of the boot binding member 15 as shown in FIG. 10. The ski boot 11 and the boot binding member 15 can then be moved laterally out of engagement with the ski binding member 14 of the ski 12.

In the embodiment of the touring ski binding shown in FIGS. 12 and 13 of the drawings the boot binding member 15 secured to the toe of the ski boot 11 is provided with an L-shaped binding element, and the ski binding member 14 secured to the upper surface of the ski 12 is formed with an L-shaped slot that is adapted to receive the L-shaped binding element of the boot binding member 15.

In this embodiment the boot binding member 15 secured to the under surface of the sole 13 of the ski boot 11 at the toe end thereof is provided with a horizontally disposed portion 55 that extends forwardly a short distance beyond the forward end of the ski boot 11 and with a transverse vertically disposed portion 56 that extends upwardly along the transverse forward edge of the horizontally disposed portion 55, the vertically disposed portion 56 of the boot binding member being formed with a latch receiving notch 57. The horizontal portion 55 and the vertical portion 56 of the boot binding member 15 comprise the L-shaped binding element of this binding member. The ski binding member 14 has a base part 59 secured to the upper surface of the ski 12, a latch part 60 pivotally mounted on the base part 59 rotational movement from its latched position to its unlatched position and return, and a latch part spring 61 urging the latch part 60 to its latched position. The base part 59 has a rearward facing transverse vertical surface 62 and is formed with a latch part receiving recess 63. The pivoted latch part 60 has a horizontally disposed portion 65 that is received in the latch part receiving recess 63 of the base part 59 and that extends rearwardly with respect to the transverse vertical surface 62 of the base part, and it has a vertically disposed transverse portion 66 that extends downwardly at the rearward edge of the horizontally disposed portion 65 a predetermined distance rearwardly with respect to the transverse vertical surface 62 of the base part. The transverse vertical surface 62 of the base part 59 and the rearwardly and downwardly extending horizontal and vertical portions 65 and 66 of the latch part 60 define between them the L-shaped binding element slot of the ski binding member 14. That is to say, the rearward facing transverse vertical surface 62 of the base part 59 of the ski binding member 14 is positioned directly in front of and in abutting relation with respect to the vertically disposed portion 56 of the boot binding member 15, the horizontally disposed portion 65 of the latch part 60 of the ski binding member 14 overlies the upper edge of the vertically disposed portion 56 of the boot binding member 15 and the vertically disposed portion 66 of the latch part 60 is positioned rearwardly of and in abutting relation with respect to the vertically disposed portion 56 of the boot binding member 15 when the binding members 14 and 15 are in mutual engagement with each other.

The boot binding member 15 is releasably secured to the ski binding member 14 by depressing the forward end of the latch part 60 with the tip of a ski pole or the like to move the rearward end of the latch part to its unlatched position. The ski boot 11 is then moved forwardly to bring the vertical portion 56 of the boot binding member 15 into abutting relationship with the transverse vertical surface 67 of the base part 59 of the ski binding member 14, and the pivoted latch part 60 of the ski binding member 14 is then allowed to return to its latched position with the horizontal portion 65 of the latch part 60 received in the latch receiving notch 57 of the boot binding member 15. The L-shaped binding element of the boot binding member 15 is now securely latched in place in the L-shaped binding element slot of the ski binding member 14. To remove the boot binding member 15 from engagement with the ski binding member 14, the forward end of the pivoted latch part 60 is again depressed to move the rearward end of the latch part to its unlatched position so that the ski boot 11 and boot binding member 15 can be moved rearwardly out of engagement with the ski binding member 14 of the ski 12.

In all embodiments of the touring ski binding of the invention, when the boot binding member 15 is releasably secured to the ski binding member 14 the toe of the ski boot 11 is securely fastened to the upper surface of the ski 12 while permitting the sole of the ski boot to flex freely and substantially preventing lateral motion of the ski boot relative to the ski when the skier is walking on his skis. In this connection, it should be noted that the forward or toe end of the sole 13 of the ski boot 11 is advantageously firmer, and less flexible than the mid-portion of the sole in order to take the strain of the binding and to prevent cramping of the toes when the heel is raised. The boot binding member 15 that is secured to the toe end of the boot sole in itself contributes to the desired stiffness of the toe of the sole, the boot binding member being secured to the boot sole 13 by any suitable means such as by screws or adhesives or by being imbedded or incorporated in the rubbery material of the boot sole 13 when the boot sole is molded in a conventional thermoplastic molding operation.

We claim:

1. A touring ski binding for releasably securing the toe of a touring ski boot to a touring ski comprising: a ski binding member secured to the upper surface of a touring ski and a boot binding member secured to the toe of a touring ski boot, each of said binding members having transversely disposed L-shaped binding elements adapted to releasably engage each other; and spring loaded latch means mounted on the ski binding member for releasably engaging the boot binding member and releasably retaining the binding members in engagement with each other;

the ski binding member having a main housing portion secured to the upper surface of the ski, a horizontally disposed transverse portion spaced a predetermined distance above the upper surface of the ski and extending rearwardly a predetermined distance from the rearward edge of the main housing portion of the ski binding member, and a vertically disposed transverse portion extending downwardly a predetermined distance at the transverse rearward edge of the horizontally disposed portion of the ski binding member, said horizontal and vertical portions of the ski binding member comprising the L-shaped binding element of said binding member;

the boot binding member having a horizontally disposed portion secured to the under surface of the ski boot at the toe end thereof and a vertically disposed portion extending upwardly along the transverse forward edge of the horizontally disposed portion of said boot binding member, said horizontal and vertical portions of the boot binding member comprising the L-shaped binding element of said binding member;

the L-shaped binding element of the ski binding member defining an L-shaped slot that is adapted to receive the L-shaped binding element of the boot binding member, and the vertically disposed portion of the boot binding member being formed with a notch that is adapted to be engaged by the spring loaded latch means mounted on the ski binding member to prevent lateral movement of said binding members relative to each other, when said binding members are in mutual engagement with each other.

2. The touring ski binding according to claim 1 in which the spring loaded latch means comprises a longitudinally disposed latch lever pivotally mounted on the ski binding member for rotational movement to its latched position and to its unlatched position, said latch lever having a forward lever arm adapted to be moved from its latched position to its unlatched position and having a rearward lever arm in position to intersect and to be partially received in the L-shaped slot formed in the ski binding member when at its latched position and to be moved upwardly out of said L-shaped slot when at its unlatched position, and a lever spring urging the latch lever to its latched position.

3. The touring ski binding according to claim 1 in which the ski binding member has a base part secured to the upper surface of the ski and a spring loaded latch part pivotally mounted on the base part of the ski binding member, the base part having a vertically disposed transverse rearward edge, and the pivoted latch part having a horizontally disposed portion extending rearwardly from the base part and a vertically disposed transverse portion extending downwardly at the rearward edge of said horizontally disposed portion a predetermined distance rearwardly with respect to the transverse rearward edge of the base part of the ski binding member, the base part and the latch part of said ski binding member defining between them the L-shaped binding element of said binding member.

4. The touring ski binding according to claim 3 in which the pivoted latch part of the ski binding member is movable about its pivot from its latched position to its unlatched position, and in which a latch part spring urges the latch part to its latched position.

5. The touring ski binding according to claim 3 in which the horizontally disposed portion of the latch part of the ski binding member is adapted to overlie the vertically disposed portion of the boot binding member and the vertically disposed portion of said latch part is positioned rearwardly with respect to said vertically disposed portion of said boot binding member when said binding members are in mutual engagement with each other.

6. The touring ski binding according to claim 3 in which the horizontally disposed portion of the latch part of the ski binding member is formed with a latch lug adapted to be received in the latch receiving notch of the vertically disposed portion of the boot binding member.

* * * * *